US005709333A

United States Patent [19]

Wang et al.

[11] Patent Number: 5,709,333

[45] Date of Patent: Jan. 20, 1998

[54] SAFETY DEVICE FOR A STAPLING GUN

[75] Inventors: Hsiu-Huang Wang; Meng-Chieh Chen, both of Taichung, Taiwan

[73] Assignee: Regitar Power Tools Co., Ltd., Taiwan

[21] Appl. No.: 755,374

[22] Filed: Nov. 25, 1996

[51] Int. Cl.[6] ..... B25C 1/04

[52] U.S. Cl. ..... 227/130; 227/8

[58] Field of Search ..... 227/8, 130, 120

[56] References Cited

U.S. PATENT DOCUMENTS

| | | | |
|---|---|---|---|
| 4,432,483 | 2/1984 | Kuck | 227/8 |
| 4,629,106 | 12/1986 | Howard et al. | 227/8 |
| 5,014,898 | 5/1991 | Heidrich | 27/130 |
| 5,551,621 | 9/1996 | Vallee | 227/130 |
| 5,605,268 | 2/1997 | Hayashi et al. | 227/8 |

*Primary Examiner*—Scott A. Smith
*Attorney, Agent, or Firm*—A & J

[57] ABSTRACT

A safety device for a stapling gun including a first switch button having an end pivotally mounted on a housing of a stapling gun, another end of the first switch button having a recess formed with a vertical rod on which is fitted a first spring, an inner side of the housing being provided with an inverted U-shaped member which is located right above the recess, the first spring being arranged between the recess of the first switch button and the inverted U-shaped member, a lower side of the first switch button having a groove, an intermediate portion of the first switch button being formed with a vertical passage which is in communication with the groove, a second switch button being pivotally connected with an end of the first switch button, a second spring being installed to push the second switch button to go outwardly from the groove, the second switch button being contoured to fit into the groove and having a protuberance adapted to fit into the vertical passage, a shaft fitted fitted within the vertical passage and enclosed with a second spring, an upper end of the shaft extending upwardly out of the vertical passage and engaged with a C-shaped retainer thereby preventing the shaft from disengaging from the vertical passage, whereby the stapling gun is only operated when the first switch button is depressed in the housing and the second switch button fitted in the first switch button.

1 Claim, 6 Drawing Sheets

SAFETY DEVICE FOR A STAPLING GUN

BACKGROUND OF THE INVENTION

1. Field of the Invention

This invention relates to a safety device for a stapling gun and in particular to one which is only operated when the first switch button is depressed in the housing and the second switch button fitted in the first switch button.

2. Description of the Prior Art

It has been found that electrical fastener driving devices, like all devices of this type, present a safety problem. This is particularly true of stapling guns which, unless appropriate safety provisions are made, have the capability of shooting fasteners in the air like a gun. Accordingly, two prior art safety devices for stapling guns have been proposed.

FIG. 1 is a perspective view of a prior art stapling gun. As shown, the stapling gun utilizes a pin 60 to engage with a switch button so that only when the pin 60 is pushed to disengage from the switch can the switch button be depressed to operate the stapling gun. However, such a safty device still suffers from the following drawbacks:

1. The pin must be manually pushed back to its safety position when the stapling gun is not in use so that if one forgets to return the pin to its original position, the stapling gun will lose its safety function at all.
2. The next user will not know whether the stapling gun is under safety condition or not.

FIG. 2 is a perspective view of another prior art stapling gun. The safety device of the stapling gun is controlled by a first switch button 71 and a second switch button 72. The first switch button 71 is engaged with the second switch button 72 so that the first switch button 71 cannot be depressed unless the second switch button 72 is first rotated in the direction of the arrow shown in FIG. 2. When in use, the second switch button 72 is first rotated in the arrow direction onto the first switch button 71 thereby disengaging its semi-circular end 721 from a retainer 73 and then the first and second switch buttons 71 and 72 are depressed altogether in the housing to operate the stapling gun. A spring 74 is used for returning the second switch 72 to its original position. Nevertheless, as the housing of most stapling guns is made of plastics, the first switch button 71 can still be depressed by a relative strong force in the housing to turn on the switch thus rendering it unsafe for use.

Therefore, it is an object of the present invention to provide an improved safety device for a stapling gun which can obviate and mitigate the above-mentioned drawbacks.

SUMMARY OF THE INVENTION

This invention relates to an improved safety device for a stapling gun.

It is the primary object of the present invention to provide a safety device for a stapling gun which utilizes a second switch button to increase the "stroke" of a first switch button to control a switch.

It is another object of the present invention to provide a safety device for a stapling gun which will automatically return to its safety position.

It is still another object of the present invention to provide a safety device for a stapling gun which can effectively prevent the stapling gun from being operated inadvertently.

It is still another object of the present invention to provide a safety device for a stapling gun which is of high security.

It is a further object of the present invention to provide a safety device for a stapling gun which is simple in construction, economical to manufacture and effective in operation.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figure 1:
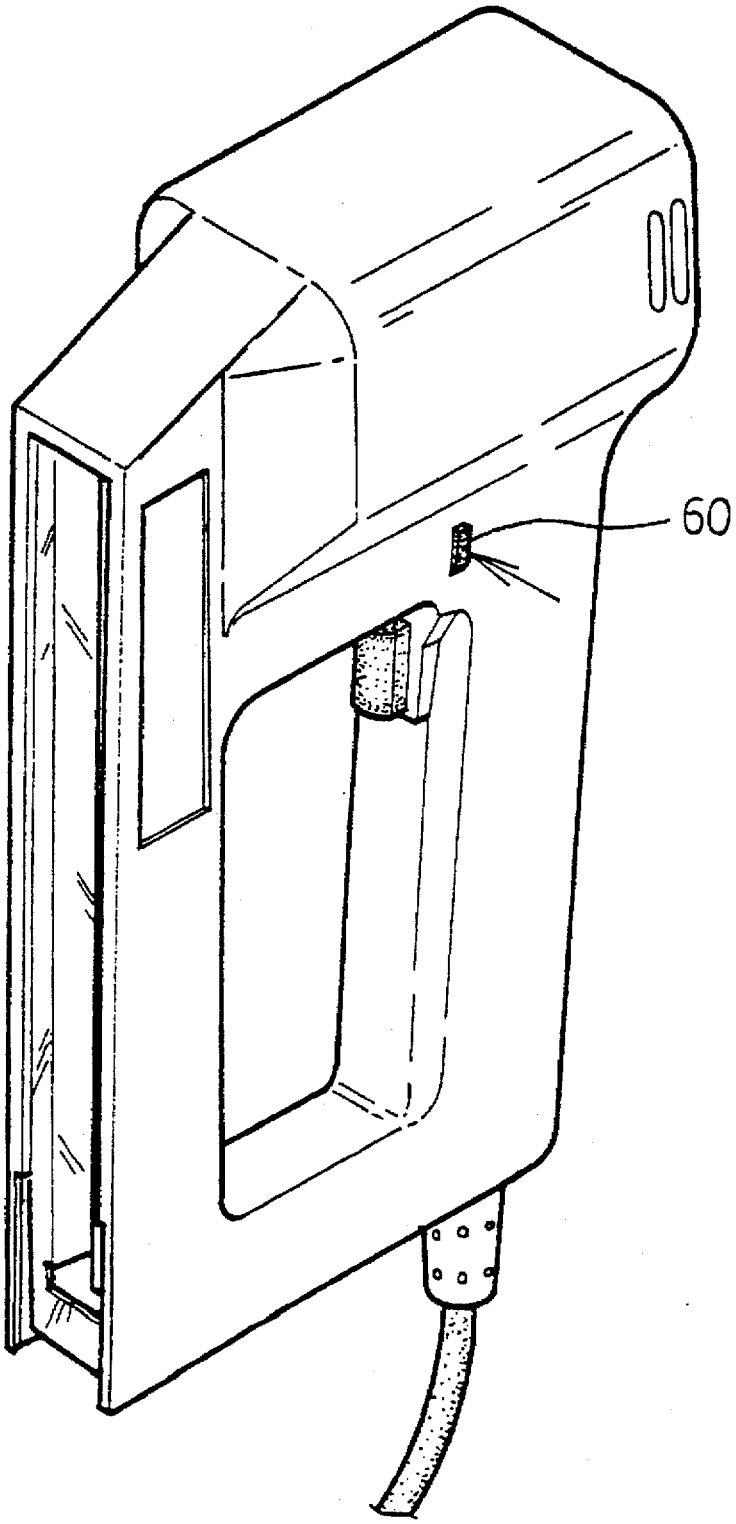
PRIOR ART FIG. 1
FIG. 1 is a perspective view of a prior art stapling gun.
Figure 2:
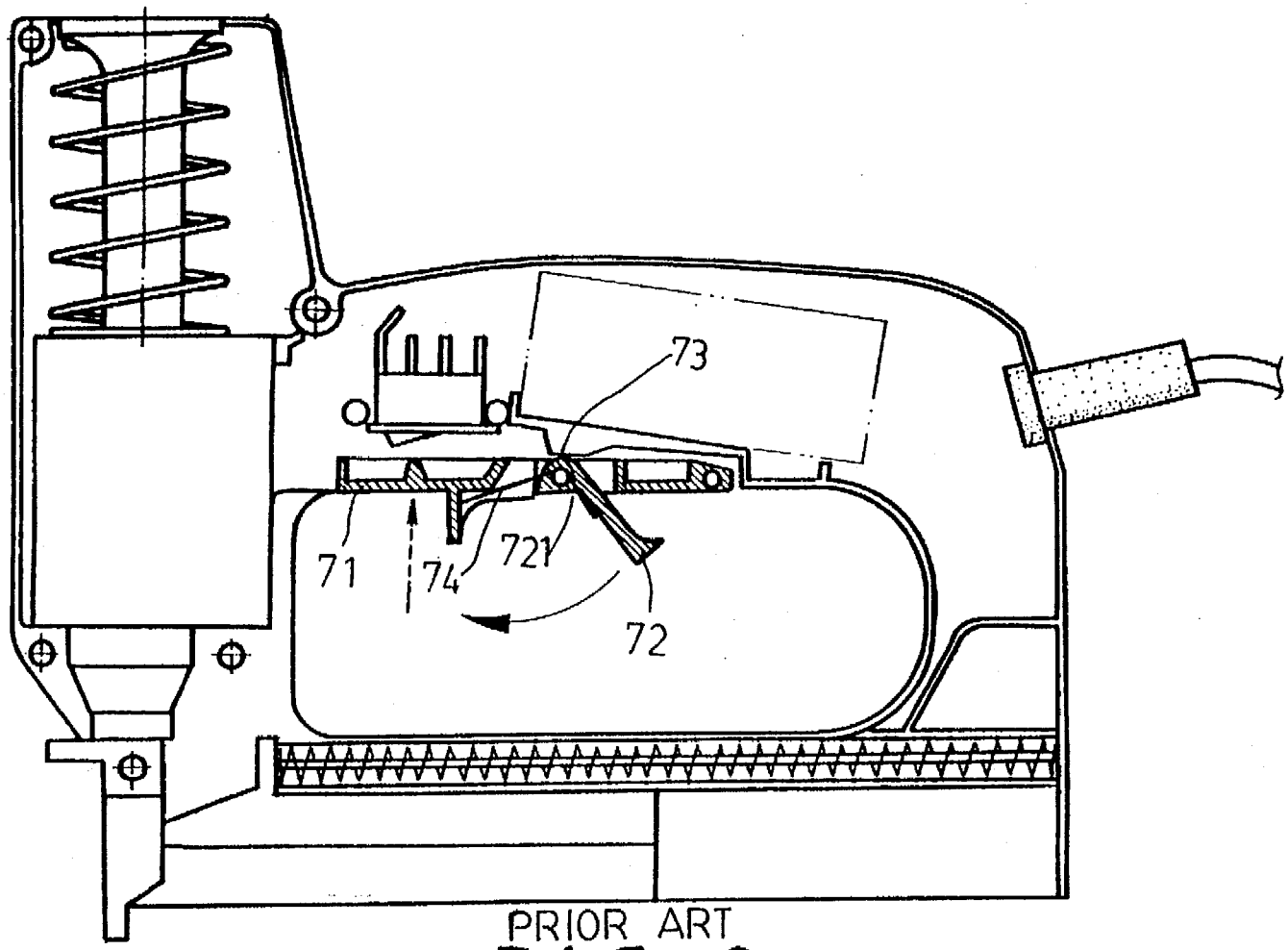
PRIOR ART FIG. 2
FIG. 2 is a perspective view of another prior art stapling gun.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 3:
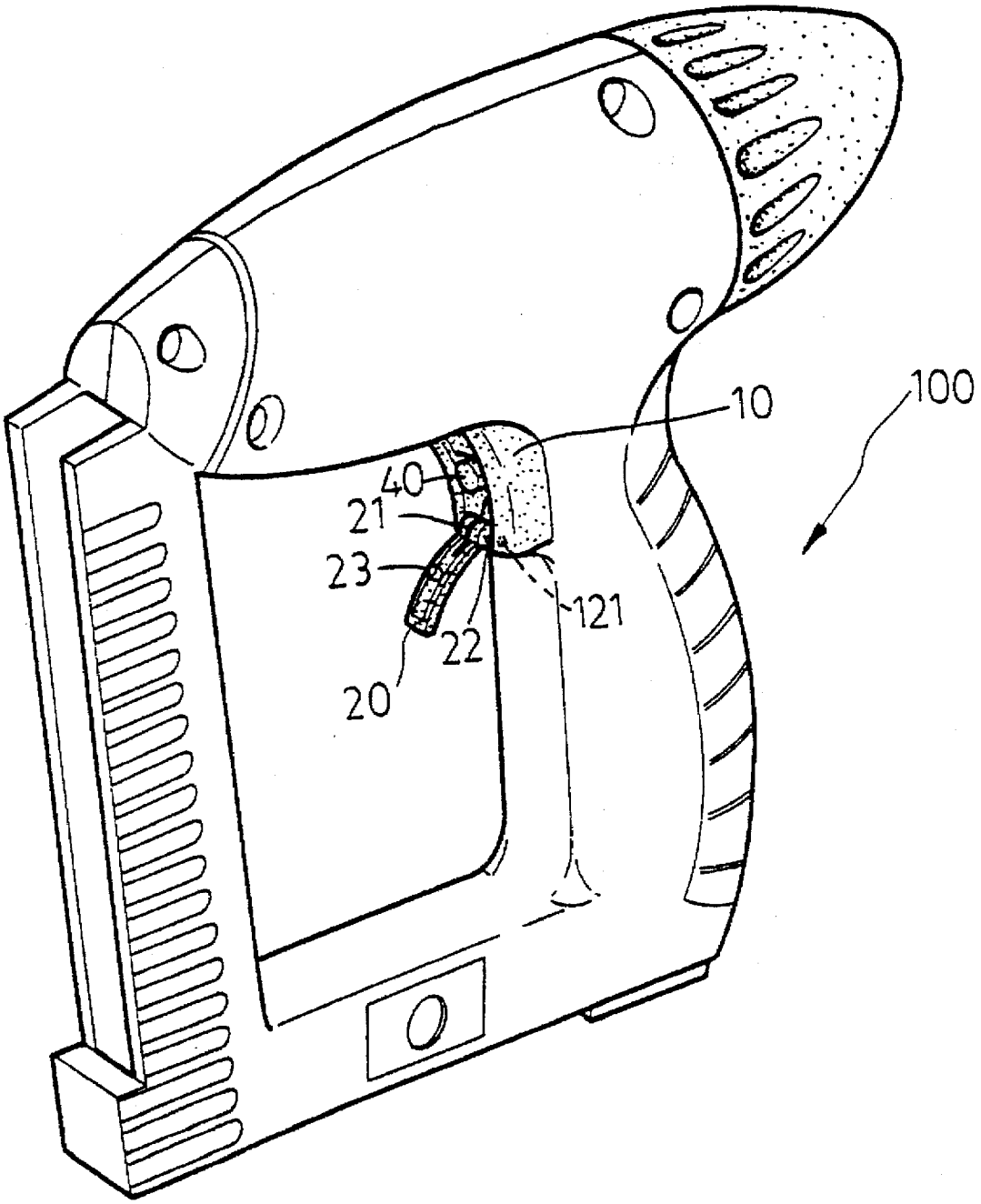
FIG. 3 is a perspective view of the present invention.
Figure 4:
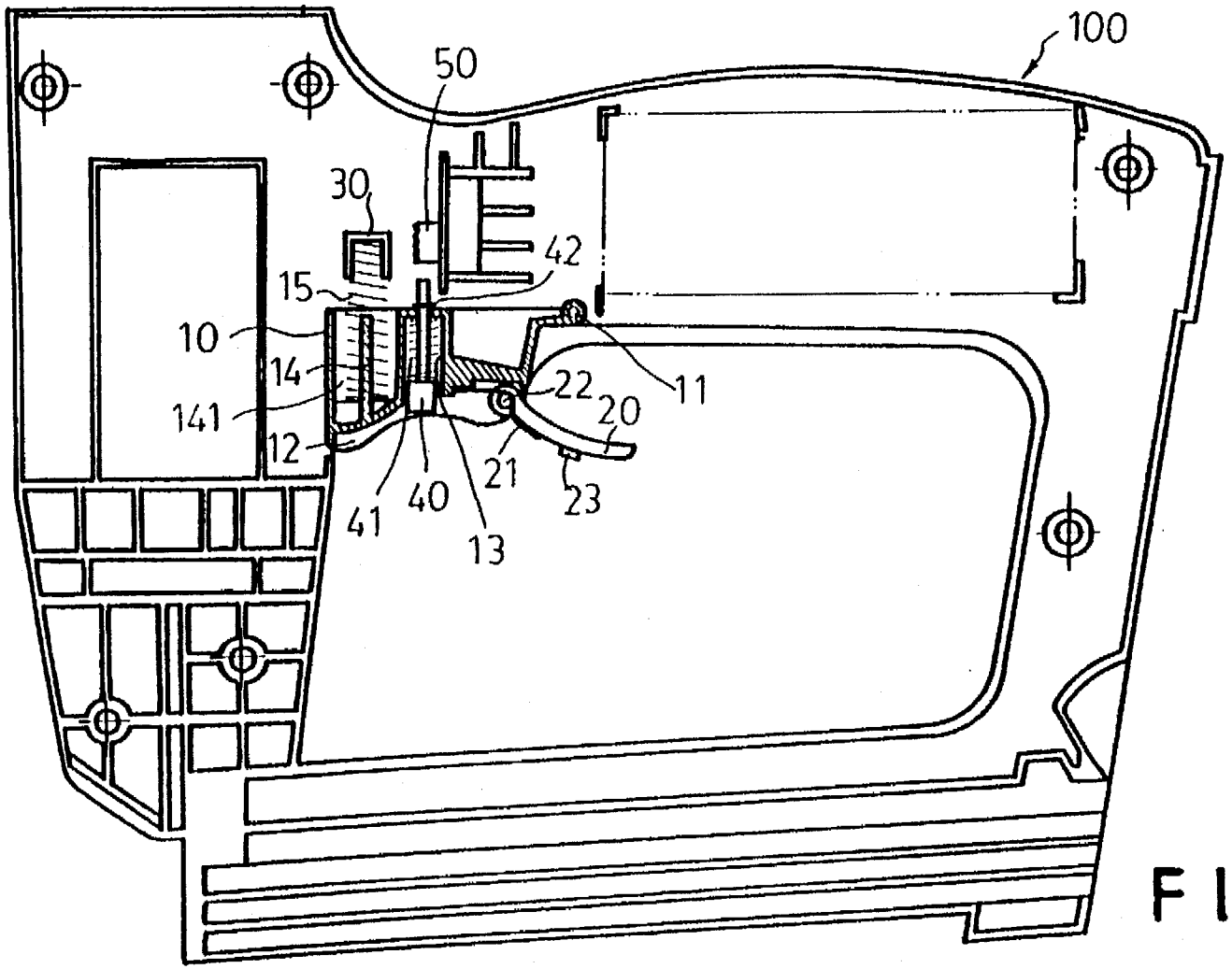
FIG. 4 is a sectional view of the present invention.

With reference to the drawings and in particular to FIGS. 3 and 4 thereof, the safety device for a stapling gun according to the present invention comprises a first switch button 10 having an end pivotally mounted on a housing 100 of the stapling gun by an axle 11 so that the switch button 10 can be rotated with respect to the axle 11. The other end of the first switch button 10 has a recess 141 formed with a vertical rod 14 on which is fitted a spring 15. The inner side of the housing 100 is provided with an inverted U-shaped member 30 which is located right above the recess 141. The spring 15 is arranged between the recess 141 of the first switch button 10 and the inverted U-shaped member 30 of the housing 100. The lower side of the first switch button 10 has a groove 12. The intermediate portion of the first switch button 10 is formed with a vertical passage 13 which is in communication with the groove 12 and has a larger cross section at the lower end. An end of the groove 12 close to the axle 11 is formed with two holes 121 at both sides of the groove 12. A second switch button 20 is pivotally connected with an end of the first switch button 10 by a pin 22 engaging with the two holes 121. A spring 21 is installed on the pin 22 to force the second switch button 20 to go outwardly from the groove 12. The second switch button 20 is contoured to fit into the groove 12 and has a protuberance 23 adapted to fit into tee vertical passage 13 of the first switch switch 10. A shaft 40 is fitted within the vertical passage 13 and enclosed with a spring 41. The upper end of the shaft 40 extends upwardly out of the vertical passage 13 and engaged with a C-shaped retainer 42 thereby preventing the shaft 40 from disengaging from the vertical passage 13 of the first switch button 10.

Figure 5A:
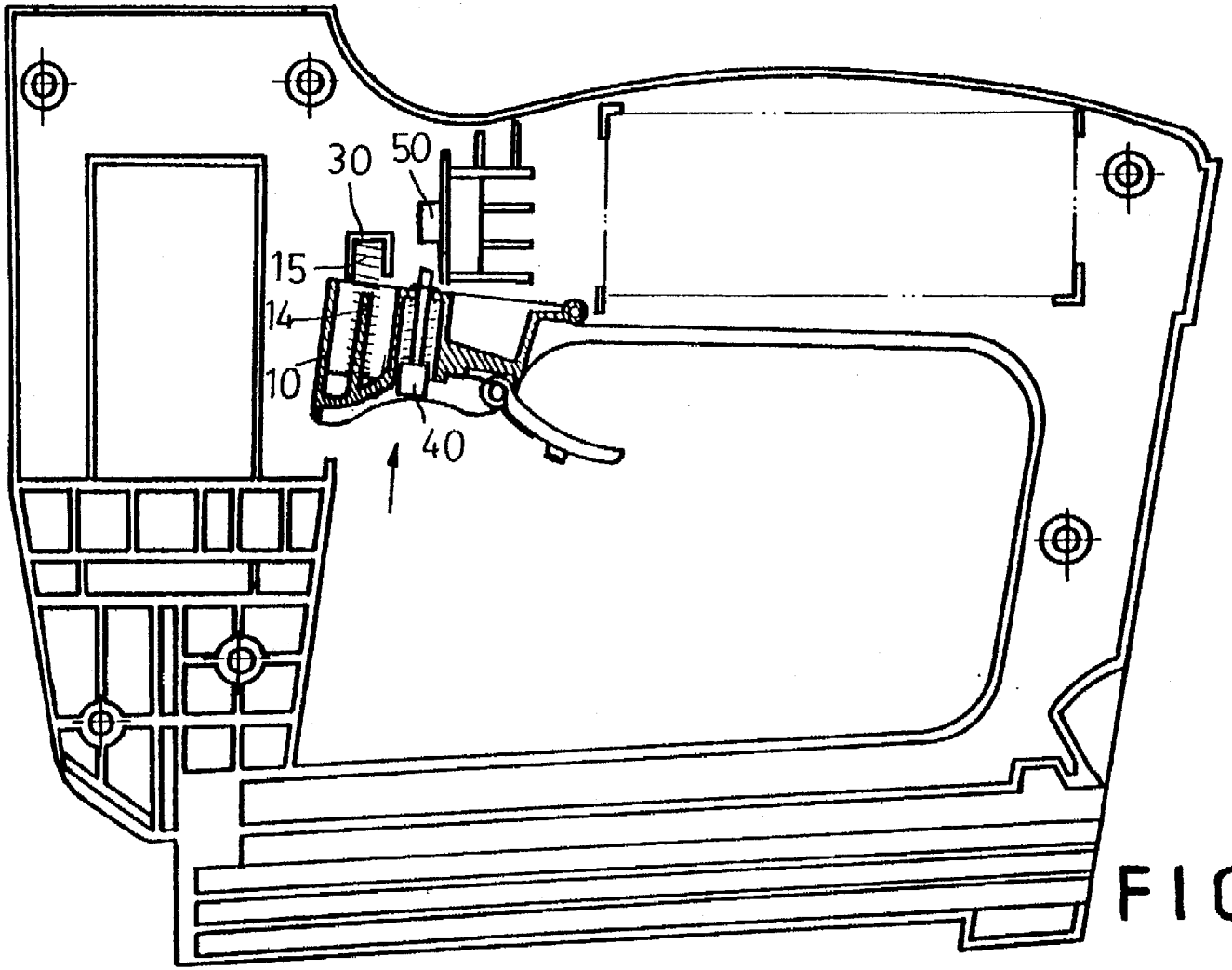
FIGS. 5A and 5B illustrate the working principle of the present invention.
Figure 5B:
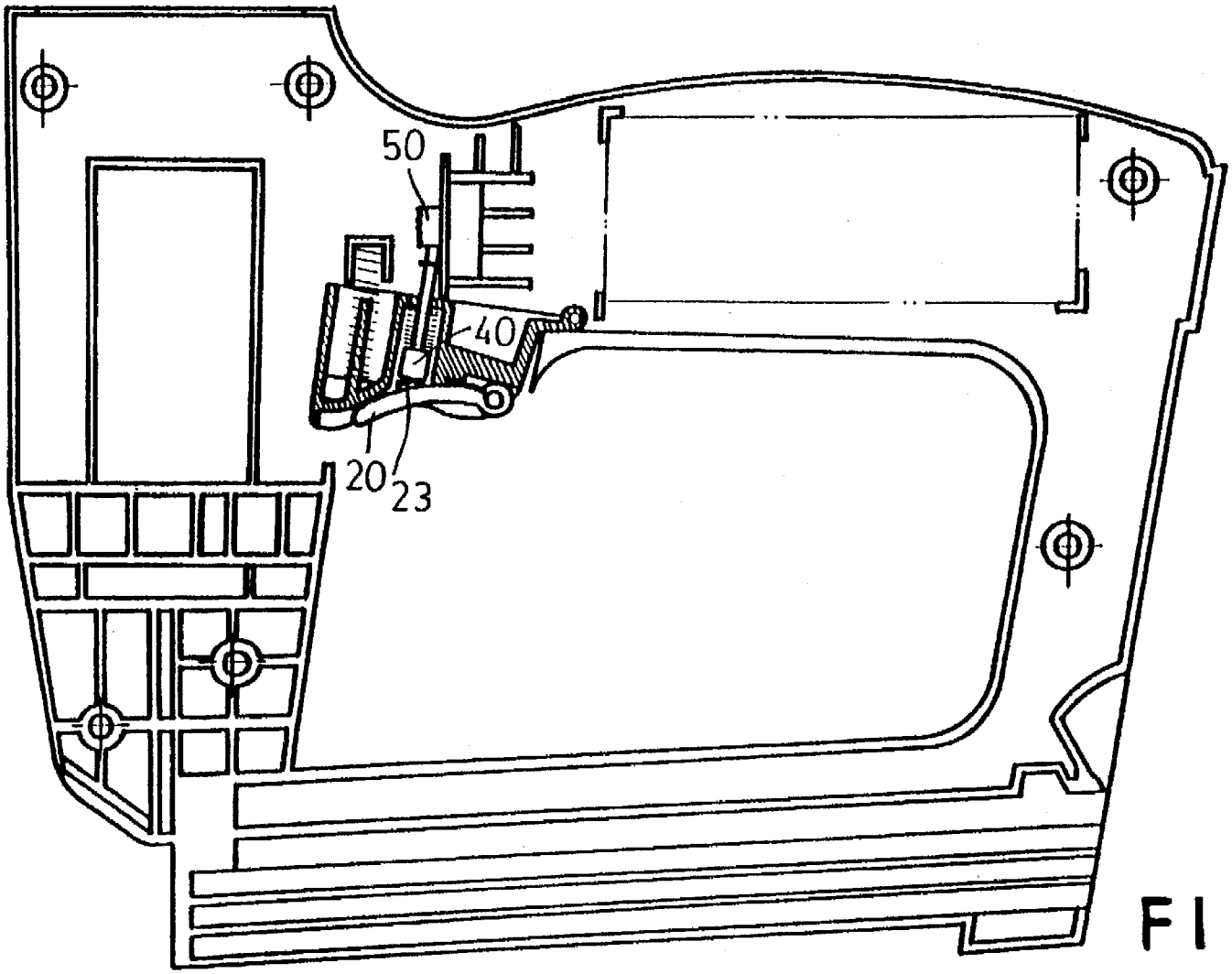

As shown in FIGS. 5A and 5B, when the first switch button 10 is pressed, the first switch button 10 will be blocked by the inverted U-shaped member 30 so that the first switch button 10 cannot go further into the housing 100 thereby preventing the shaft 40 from pushing on the switch 50.

When the second switch button 20 is depressed on the first switch button 10, the protuberance 23 of the second switch button 10 will force the shaft 40 to move upwardly to push on a switch 50 which is arranged within the housing 100.

As the first and second switch buttons 10 and 20 are released, the springs 15 and 41 will be restored to move the first and second switch buttons 10 and 20 to their original positions.

Hence, the stapling gun is only operated when the first switch button 10 is depressed in the housing and the second switch button 20 fitted in the first switch button thereby the stapling gun from being operated inadvertently and therefore ensuring safety.

In brief, the present invention provides a safety device for a stapling gun which utilizes a second switch button to increase the "stroke" of a first switch button to control a switch.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A safety device for a stapling gun comprising a first switch button having an end pivotally mounted on a housing of a stapling gun, another end of said first switch button having a recess formed with a vertical rod on which is fitted a first spring, an inner side of said housing being provided with a switch and an inverted U-shaped member which is located right above said recess, said first spring being arranged between said recess of said first switch button and said inverted U-shaped member, a lower side of said first switch button having a groove, an intermediate portion of said first switch button being formed with a vertical passage which is in communication with said groove, a second switch button being pivotally connected with an end of said first switch button, a second spring being installed to push said second switch button to go outwardly from said groove, said second switch button being contoured to fit into said groove and having a protuberance adapted to fit into said vertical passage, a shaft fitted within said vertical passage and enclosed with a second spring, an upper end of said shaft extending upwardly out of said vertical passage and engaged with a C-shaped retainer thereby preventing said shaft from disengaging from said vertical passage, whereby when said first switch button is depressed, said first switch button will be blocked by said inverted U-shaped member so that said first switch button cannot go further into said housing thereby preventing the shaft from pushing on said switch and when said second switch button is depressed in said first switch button, said protuberance of said second switch button will force said shaft to move upwardly to push on said switch.

* * * * *